US005111789A

United States Patent [19]

Moriya et al.

[11] Patent Number: 5,111,789

[45] Date of Patent: May 12, 1992

[54] METHOD FOR CONTROLLING TORQUE OF A PUMP

[75] Inventors: Naoyuki Moriya, Kobe; Makoto Sameshima, Takasago, both of Japan

[73] Assignee: Shin Caterpillar Mitsubishi Ltd., Minato, Japan

[21] Appl. No.: 540,906

[22] Filed: Jun. 19, 1990

[30] Foreign Application Priority Data

Jun. 21, 1989 [JP] Japan ..... 1-159069

[51] Int. Cl.[5] ..... F02M 39/00

[52] U.S. Cl. ..... 123/357; 417/218

[58] Field of Search ..... 417/218, 222, 380; 123/357, 385, 386, 387; 60/433, 434

[56] References Cited

U.S. PATENT DOCUMENTS 4,606,313 8/1986 Izumi et al. ..... 123/386

4,773,369 9/1988 Kobayashi et al. ..... 123/385 X

*Primary Examiner*—John Rivell

*Attorney, Agent, or Firm*—Morrison Law Firm

[57] ABSTRACT

A torque control system for variable delivery pumps receiving torque from an engine employs a signal related to an engine torque available at each engine speed setting to control the torque, and thus the amount of engine power that is absorbed by the variable delivery pumps. In a low-power regime, wherein the fuel injected into the engine is less than maximum, torque control is effected by comparing the available torque with an amount of torque that would be available at maximum fuel injection. In a high-power regime, wherein the fuel injected is at least a predetermined value, torque contol is effected by comparing the available torque with an amount of torque that is available at a combination of a set engine speed and an actual engine speed. A bias circuit biases the stable speed operating point a small amount below the maximum speed, whereby improved fuel economy is attained. In a system with more than one variable delivery pump, when less than the full number of pumps is employed, control is effected in the low-power regime, even though all pumps in service are receiving maximum fuel.

7 Claims, 3 Drawing Sheets

METHOD FOR CONTROLLING TORQUE OF A PUMP

BACKGROUND OF THE INVENTION

Field of the Invention

The present invention relates to a method for controlling the torque of a pump of a type frequently used for construction machines and other similar machines in which regulators are driven by a plurality of pumps.

FIG. 6 is a schematic drawing showing a configuration of a conventional engine pump using two pumps. Variable delivery pumps 2*a* and 2*b* include swash plates 3*a* and 3*b*, which vary the discharge flow rates of the pumps are driven by an engine 1. Swash plates 3*a* and 3*b* are provided with are driven by regulators 4*a* and 4*b*. An operation lever 5 provides pilot pressure that varies in proportion to its operating position through lines 6*a* and 6*b* to regulators 4*a* and 4*b*. One or both swash plates 3*a* and 3*b* may be driven in dependence on the setting of operation lever 5. Since the apparatus of FIG. 6 is conventional, further explanation of the selecting circuit for this operation is omitted.

Swash plates 3*a* and 3*b* are controlled by pilot pressure from lines 6*a* and 6*b* in response to the position of operation lever 5 as well as a discharge pressure of pumps 2*a* and 2*b* themselves. The change of position of the swash plates is limited by restricting power so that the change of position does not exceed the output power of the engine when load is applied, i.e., when discharge pressure is great.

Referring now to FIG. 3, conventionally, the total output power of a pump is set, allowing a margin of the design engine output. This permits the engine to operate within the governor area. The governor area means the range of engine output torque variation in output torque is capable of controlling the engine speed over a relatively narrow range. Point B is located at the upper limit of the governor area. Below point B, the engine speed can be controlled by varying rack displacement, as long as rack displacement remains less than the maximum rack displacement. At the maximum rack displacement, the speed is in the lagging area.

Fuel consumption characteristics (in the figure, higher engine speed indicates less economical fuel consumption) is not favorable with the engine speed at point B, suggesting that it is not operating efficiently.

Further, the output of each pump is a fixed value. Therefore, when one of the two pumps is driven, for example, less than half the engine power is used.

In short, the prior art presents the following drawbacks:

(1) the engine is operated under unfavorable, inefficient conditions with respect to fuel consumption, and (2) available engine power is not used to its full extent.

Another example of a controlling device is disclosed in Japanese Patent Application Laid-Open No. 50686/1988 that calls for establishing a pump absorption characteristic which makes a pump do a specified amount of work based on engine speed. This is accomplished by controlling the pump swash plates (in other words the pump discharge flow rate) according to the pump power absorption characteristic and the pump discharge pressure.

As shown in FIG. 3, engine output characteristics vary considerably, depending on whether the engine speed is in the governor area, where the engine speed can be maintained at more or less a fixed level regardless of a small change in engine output torque, or in the lagging area, where such control is ineffective. Therefore, while it is necessary to switch the pump absorption torque in accordance with the area in which the rack displacement is located, the control device presented in the above Japanese Patent Application Laid-Open No. 50686/1988 does not solve this problem.

OBJECTS AND SUMMARY OF THE INVENTION

It is an object of the present invention to provide a control system for a variable delivery pump which overcomes the drawbacks of the prior art.

It is a further object of the invention to provide means for operating an engine under optimum conditions by correcting pump absorption torque by a correcting system that depend on the relative magnitudes of the rack command value and the maximum rack displacement.

Briefly stated, the present invention provides a torque control system for variable delivery pumps receiving torque from an engine. The system employs a signal related to an engine torque available at each engine speed setting to control the swash plate angles, and thus the amount of engine power that is absorbed by the variable delivery pumps. In a low-power regime, wherein the fuel injected into the engine is less than maximum, pump torque control is effected by comparing the available torque with a predetermined value of torque that would be available near maximum fuel injection. In a high-power regime, wherein the fuel injected is at least the maximum, pump torque control is effected by comparing the available torque with an amount of torque that is available at a combination of a set engine speed and an actual engine speed. A bias circuit biases the stable speed operating point a small amount below the maximum torque, thus producing a reference value, referred to as a predetermined value, whereby improved fuel economy is attained. In a system with more than one variable delivery pump, when less than the full number of pumps is employed, control is effected in the low-power regime, even though all pumps in service are receiving maximum fuel.

According to an embodiment of the invention, there is provided an apparatus for controlling torque of an engine pump system, the torque determining a pumping effectiveness of a plurality of variable delivery pumps, the variable delivery pumps being driven by an engine of a type having a fuel injection pump, comprising: means for producing a rack command value, the rack command value having a maximum, the rack command value being useable by the fuel injection pump for injecting fuel into the engine, means for producing a first signal related to an engine torque at each value of the rack command value, means for producing a second signal related to engine torque at each value of engine speed, means for determining a third signal related to engine torque at each value of engine speed command, means, responsive to the rack command value being at a predetermined value related to the maximum, for controlling the torque in response to sum of the third signal and the second signal to produce a first sum, means for biasing the first sum to a low-speed side of an engine response, and means responsive to the rack command being less than the predetermined value for controlling the torque in response to a sum of the third signal and an engine torque produced with a rack displacement corresponding to the predetermined value.

According to a feature of the invention, there is provided apparatus for controlling swash plates in at least one variable delivery pump, the variable delivery pump being of a type effective to absorb torque and power from an engine, comprising: means for producing a torque signal indicative of a torque produced by the engine at all engine speeds, means for injecting fuel into the engine, the means for injecting fuel including a predetermined value, means, responsive to the predetermined value, for controlling the torque in response to a difference between the torque signal and a controlled signal derived from a set engine speed and an actual engine speed, and means for biasing the difference to a low-speed side of a maximum speed, whereby the engine is controlled to operate in a fuel-efficient speed range.

According to a further feature of the invention, there is provided a method for controlling swash plates in at least one variable delivery pump, the variable delivery pump being of a type effective to absorb torque and power from an engine, comprising: producing a torque signal indicative of a torque produced by the engine at all engine speeds, injecting fuel into the engine, the step of injecting fuel including a predetermined value, during an existence of at least the predetermined value, controlling the torque in response to a difference between the torque signal and a controlled signal derived from a set engine speed and an actual engine speed, and biasing the difference to a low-speed side of a maximum speed, whereby the engine is controlled to operate in a fuel-efficient speed range.

The present invention relates to a method to control the torque of a variable delivery pump of an engine pump type which calls for driving a plurality of variable delivery pumps 2a and 2b by engine 1 having a fuel injection pump, wherein if rack command value 23, which actuates the control rack of the fuel injection pump, exceeds a predetermined value (i.e., about 90 percent of maximum rack displacement 22), in other words in case of heavy loads, the pump torque command is the sum of signals with engine output torque $T_E$ corresponding to set engine speed 10 as the pump absorption torque and of signals $T_F$ produced by correcting the pump absorption torque so as to make actual engine speed 11 lower than the above set engine speed 10. If rack command value 23 is less than a predetermined value (90 percent of maximum rack displacement 22) or in case of light loads, the pump torque command is the sum of signals with engine output torque TE corresponding to set engine speed 10 as the pump absorption torque and of signals produced by correcting the pump absorption torque so that rack command value 23 is equal to maximum rack displacement 22.

The present invention makes it possible, in case rack command value 23 exceeds the predetermined value due to heavy loading of engine 1 by the driving of all pumps, or for other reasons, to the required engine output torque $T_E$ (corresponding to Point A in FIG. 3) which acts as a pump absorption torque and corresponds to the set engine speed determined by means of an accelerating lever, etc., to pumps 2a and 2b and at the same time to further correct (i.e., increase) the pump absorption torque so that actual engine speed 11 becomes lower (corresponding Point C in the lagging area shown in FIG. 3) than the set engine speed 10 and thereby to operate engine 1 in an area of more stability than point A, which is unevenly distributed, and also to improve the fuel consumption rate.

When the load on engine 1 is small, the rack command value 23 is less than the predetermined value, because only one pump is being driven or for other similar reasons. A relatively small engine output torque $T_E$ is required, as pump absorption torque, of pump 2a. The pump absorption torque is corrected (i.e., increased) until the rack command value 23 equals maximum rack displacement 22, thereby increasing load to a value which utilizes nearly 100% of the engine power.

The above, and other objects, features and advantages of the present invention will become apparent from the following description read in conjunction with the accompanying drawings, in which like reference numerals designate the same elements.

DETAILED DESCRIPTION OF PREFERRED EMBODIMENT

Figure 6:
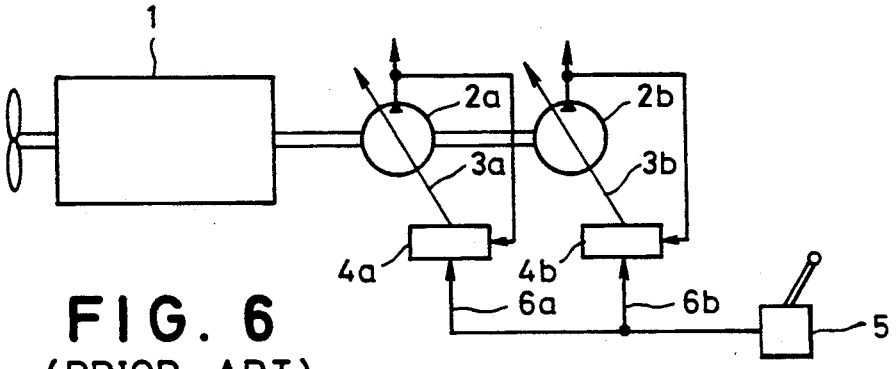
FIG. 6 (PRIOR ART)
FIG. 6 is a schematic structure drawing of a conventional engine pump controlling system.

In the description which follows, explanation of parts and elements that are identical to the prior-art control circuit of FIG. 6 is omitted.

Briefly, the apparatus of the present invention employs a predictor of the amount of torque available at all commanded engine speeds as a reference for comparison with a processed error signal indicating the amount of torque actually being generated by the speed setting of the engine. A system using a selectable number of a plurality of pumps enables operation with less than full engine power.

Figure 1:
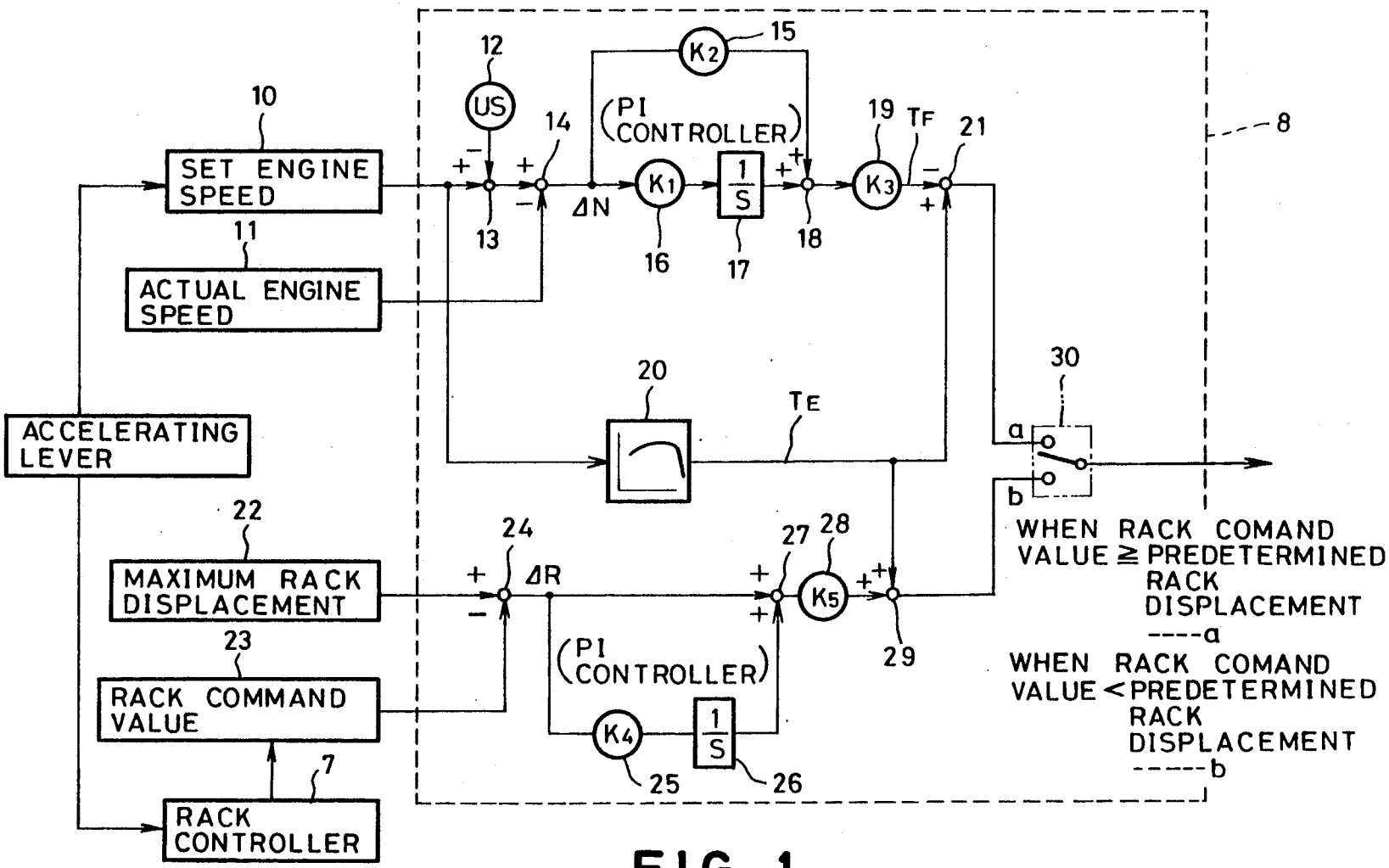
FIG. 1 is a block line drawing of a pump torque controller according to an embodiment of the present invention.
Figure 2:
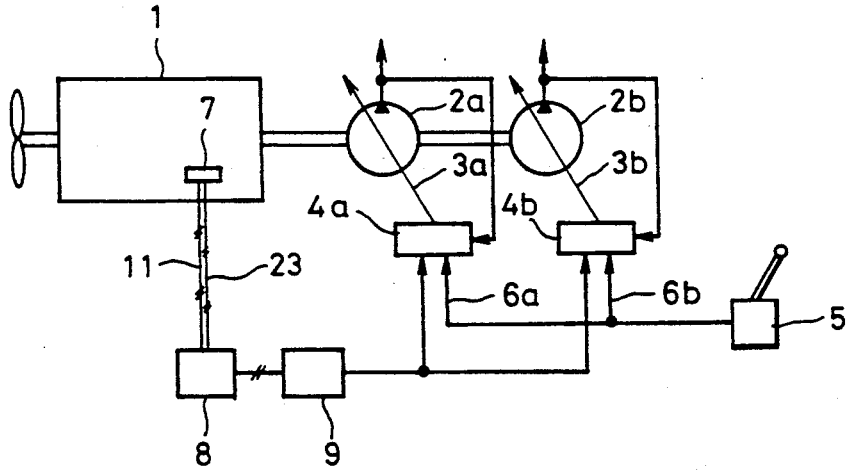
FIG. 2 is a schematic drawing of an engine pump controlling system including the above pump torque controller.

Referring to FIGS. 1 and 2, engine 1 includes a fuel injection pump and a controller 7. Controller 7 controls the control rack (hereinafter referred to as the rack) of the fuel injection pump. A pump torque controller 8 serves controller 7. Actual engine speed 11 and rack command value 23 are conveyed from controller 7 to pump torque controller 8 via an electric signal line. An electric/oil pressure converter 9 produces a pump torque command for pump torque controller 8 via an electric signal line. The pump torque command is converted to an oil pressure command by swash plate regulators 4a and 4b.

FIG. 1 illustrates the pump torque controller 8, and shows a set engine speed 10 determined by the setting of an accelerating lever or by other means and actual engine speed 11, which is the actual revolution rate of the engine. The pump absorption torque correction circuit operative in the lagging area (shown in FIG. 3) is comprised of underspeed control 12 of the engine speed from point A to point C in FIG. 3 (hereinafter referred to as under speed volume US), summers 13 and 14, proportional gain K2 15, integral gain K1 16, integral factor 17, summer 18 of proportional factors and integral factors, and conversion coefficient K3 19 to convert engine speed variation to a torque variation signal $T_F$.

The torque available from the engine at the selected speed is the engine output torque signal $T_E$ produced by circuit 20. The engine output torque signal $T_E$ is connected to the plus input of summer 21. The amount of torque that can be absorbed by the pumps is calculated and applied to the minus input of summer 21. The signal $T_E$ and the amount of torque that the pumps can absorb are subtracted from each other in summer 21 to produce the pump torque command.

When less than all of the pumps are used for absorbing engine torque, the swash plates are controlled in response to rack inputs and outputs, rather than speed inputs and outputs. In this situation, control is maintained in the governor area (FIG. 3).

A pump absorption torque correction circuit which works in the governor area (shown in FIG. 3) comprises a preset maximum rack displacement 22, a rack command value 23, conveyed from rack controller 7 (the rack command value referred to herein is a command value to the engine rack regulators, and the present invention calls for utilizing this command value to control the pump swash plates), summer 24 for summing the maximum rack displacement 22 and the rack command value 23, integral gain K4 25, integral factor 26, summer 27, product K5 28, and summer 29 adding together for engine output torque $T_E$ and the output of proportional gain K5 28. The proportional gain provided by product K5 28 introduces a necessary conversion coefficient to convert rack variation to torque variation. Product K5 28 is hereinafter referred to as proportional gain K5.

Figure 3:
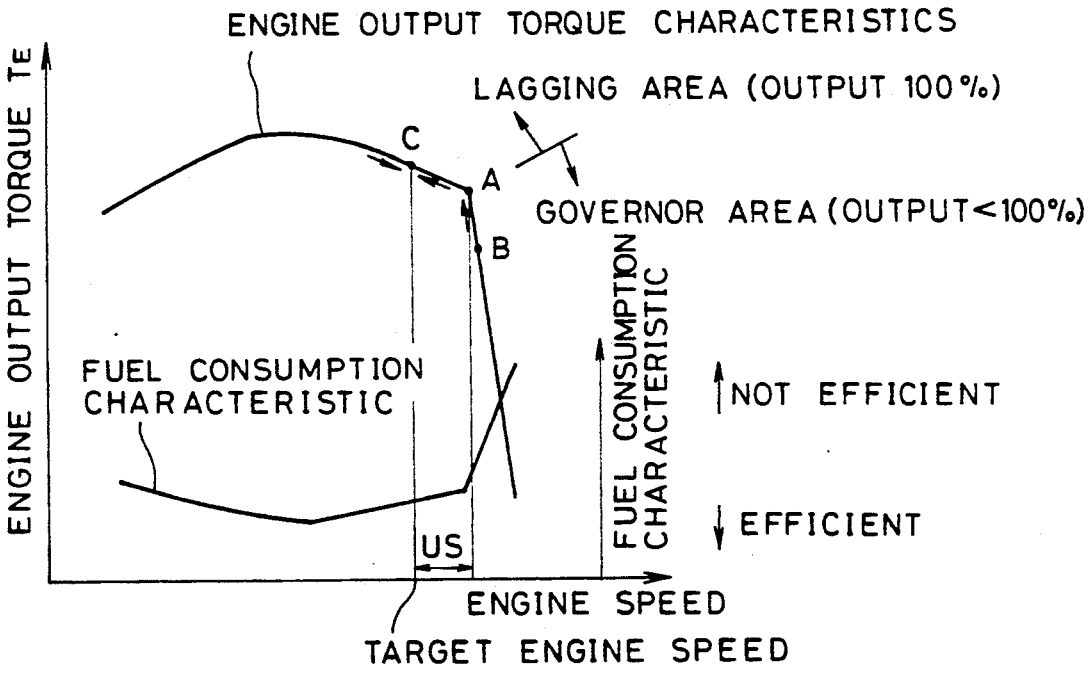
FIG. 3 is a graph showing the engine/torque characteristics and fuel consumption characteristics.

As shown in FIG. 1, a switch 30 switches between the pump absorption torque correction circuit working in the lagging area (FIG. 3) and that working in the governor area (FIG. 3). The "a" contact of switch 30 is used when the rack command value 23 is greater than or equal to the predetermined value (90 percent of maximum). In this circumstance, control responds to engine speed. The "b" side of switch 30 is connected when rack command value 23 is less than the predetermined value. In this circumstance, control responds to rack commands and responses.

Point A in FIG. 3 is a discontinuous intersecting point of the governor area and the lagging area. The unevenness of the curve at point A raises the possibility that stable operation may not be maintained in this vicinity. Therefore, in order to maintain stable operation, the operational condition is controlled to move beyond point A to point C. This control performed by the portion of pump torque controller 8 between actual engine speed 11 and conversion coefficient 19. Under speed volume (US) 12 applies a slight negative increment to set engine speed 10 so that the actual commanded speed applied to summer 14 is in the vicinity of point C in FIG. 3. PI control is performed by a PI (proportion-+integral) controller which includes the portions of pump torque controller 8 ranging from proportional gain 15 to summer 18 in order to make deviation delta N between the target speed and actual engine speed 11 approach zero. Since the output from the PI controller is in dimensions of the revolution rate, such output is converted to torque by the conversion coefficient 19. Integral factor 17 of the PI controller used in this stage has maximum and minimum values for improved control response. The output of the above conversion coefficient 19 is subtracted from the engine output torque $T_E$ at summer 21 to produce the pump torque command.

Figure 4A:
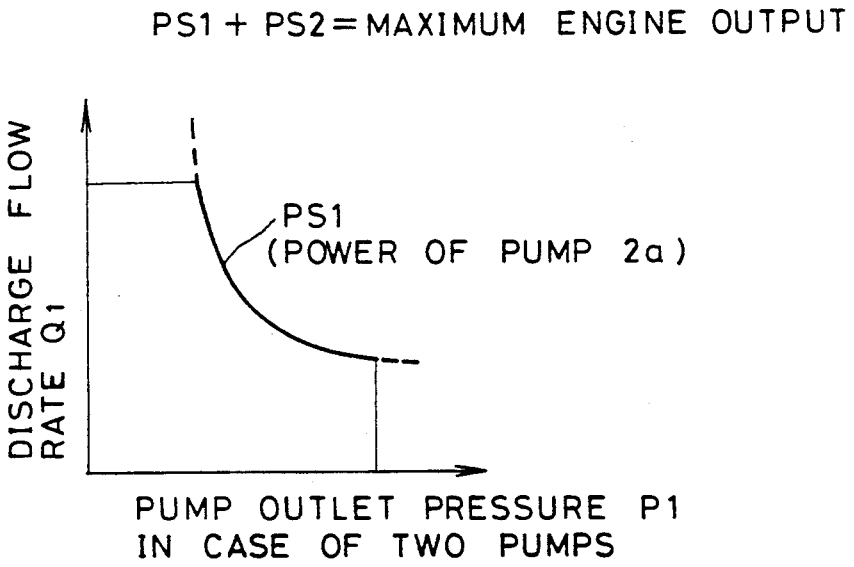
FIG. 4A–4B and FIG. 5 are sets of graphs showing the pump power characteristics.
Figure 4B:
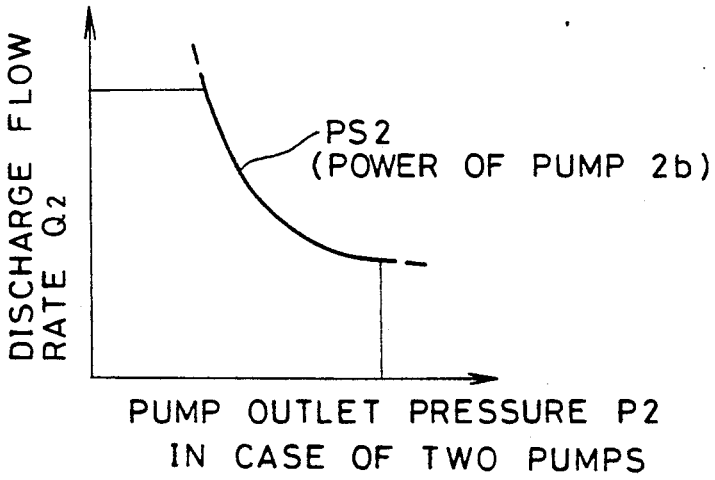
Figure 5:
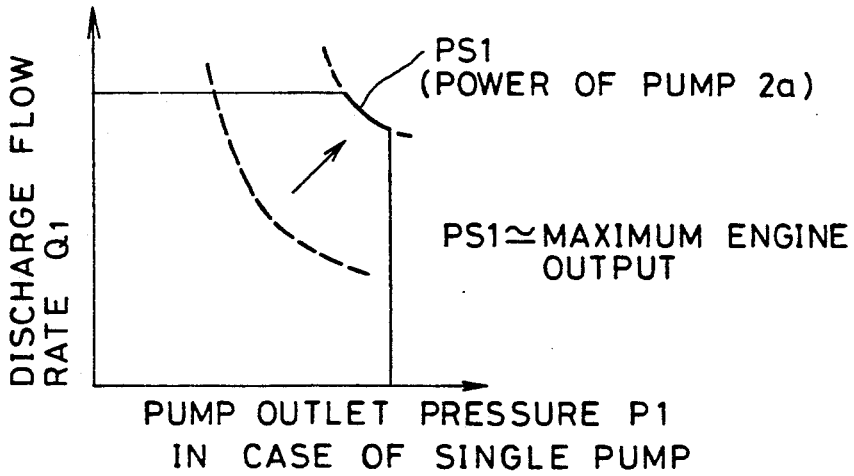

FIG. 4A and FIG. 4B illustrate pressure versus discharge flow rate conditions for a system using two pumps. FIG. 5 illustrates pressure versus discharge flow rate during one-pump operation. The horizontal axes of these figures indicate the discharge pressure of the pumps P1 and P2, and the vertical axes show the discharge rates of pumps Q1 and Q2. The curves (i.e., hyperbolas) shown as PS1 and PS2 in the figures can be used to calculate pump power (P1×Q1 and P2×Q2 respectively). The present invention calls for controlling the pump absorption torque (the load torque which the pump absorbs from the engine output torque in the form of pump discharge pressure multiplied by pump discharge flow rate). This is equivalent to controlling the operating positions along pump power curves PS1 and PS2 in the figures. Further, the power referred to hereinabove equals engine torque multiplied by engine speed. When the engine speed is constant, the ratio of engine power to engine torque is 1:1. With two pumps, the sum of power PS1 of one pump 2A and the power PS2 of the other pump 2B equals the maximum output of the engine.

Referring to FIG. 1, in operation, when the actual engine speed 11 is lower than the target speed, the actual engine speed is found to the left of point C in FIG. 3. The engine is overloaded in this condition. The output delta N at summer 13 is positive, making the control output of the PI (proportion+integral) controller positive. This control output, modified by multiplication by positive conversion coefficient K3 to produce the signal $T_F$, is subtracted from engine output torque $T_E$ at summer 21. When the pump torque command is decreased based on the above value, pump power moves along curves PS1 and PS2 toward the bottom-left portions of FIGS. 4A and 4B. In short, in response to reduced engine loading, the engine speed is permitted to increase gradually.

In contrast, if the actual engine speed 11 is greater than the target speed (point C in FIG. 3), the pump absorption torque is less than the target value. Delta N is negative, and the control output of the PI controller, times the conversion coefficient K3 19, applies a value $T_F$ to summer 21 that exceeds the engine output torque $T_E$ by an amount equal to conversion coefficient K3. This causes the operating points to move along the pump power curves PS1 and PS2 toward the right-upper portion of FIGS. 4A and 4B. The resulting increased loading on the engine tends to lower the engine speed gradually until it is regulated in the vicinity of the target speed at point C.

As illustrated in FIG. 3, it is evident that regulating the engine speed to the target speed point C by controlling the pump swash plates is advantageous with respect to fuel consumption efficiency.

The following explanation is directed to operating when only a single pump controlled by the operation lever.

Single-pump operation is used when the total load to the engine is small. Rack command value 23 from rack controller 7 is less than the predetermined value, and therefore contact "b" of switch 30 (FIG. 1) is selected. The control from maximum rack displacement 22 to summer 29 functions to make point B in FIG. 3 approach point A as closely as possible in the governor area. In this stage, too, engine output torque TE, described above, acts as the basis of control.

Maximum rack displacement 22 corresponds to the rack displacement at point A in FIG. 3. Here, the output of PI controller, derived from integral gain 25 and fed to proportional gain 28, makes rack command value 23 identical to the maximum rack displacement 22. That is, it makes the difference delta R between them approach zero, thereby increasing the pump absorption torque. As described above, proportional gain 28 provides a factor which converts from the dimension of rack displacement to that of torque.

The output of proportional gain 28 and engine output torque TE, which is the output of engine output torque characteristics 20, are added together at summer 29 to produce the pump torque command. The integral factor K4 25 in the PI controller has maximum and minimum values selected to prevent the engine from running away.

The above condition is illustrated in the power characteristics curve of FIG. 5. The illustration uses the example wherein only pump 2A, producing power curve PS1, is effective. It will be noted that the position of the power curve PS1 in FIG. 5 is considerably higher and to the right of the corresponding curve in FIG. 4A. This difference indicates the increase in power required from a single pump. Nevertheless, if the maximum power of one pump is less than the maximum output of the engine, the operating point on the engine output torque characteristic curve of FIG. 3 cannot be moved far enough to reach point A. In that case, reversion to multiple-pump operation is indicated.

Even when using two pumps, if the operating load is small, such as occurs when making fine adjustments, control similar to the single-pump control, described above, may be performed, with the pump torque command being output to the two pumps to produce a sum of powers approximating the fully loaded single-pump power shown in FIG. 5. Since swash plate regulators **4*a* and 4*b* are also driven by the pilot pressure of operational lever 5**, the ability for fine adjustment is secured with implementation of an oil hydraulic pressure circuit which gives priority to the pilot pressure.

As described as above, a control method according to the present invention enables the following:

(1) in case of heavy load, where all the pumps are in operation, the engine output is utilized to its full extent in a safe area, that also operates the engine in an operating region good fuel efficiency can be achieved; and (2) in case of a lightly loaded engine using, for example, a single pump, the engine output is utilized to its full extent.

With a pump torque control method according to the present invention, it is possible to utilize nearly 100% of the engine output to respond to a heavy load wherein all pumps are used. This operation is done with the engine output in a stable condition, thereby operating the engine with an efficient fuel consumption rate, by means of correcting the pump absorption torque, which is the basis of pump swash plate control, in such a manner that the actual engine speed is regulated to a value lower than the set engine speed. Under light load, nearly 100% of the engine power is used by correcting the pump absorption torque in such a manner that the rack command value is close to the maximum rack displacement.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An apparatus for controlling torque of an engine pump system, said torque determining a pumping effectiveness of a plurality of variable delivery pumps, said variable delivery pumps being driven by an engine of a type having a fuel injection pump, comprising:

means for producing a rack command value;

said rack command value having a maximum;

said rack command value being useable by said fuel injection pump for injecting fuel into said engine;

means for producing a first signal related to an engine torque at each value of said rack command value;

means for producing a second signal related to engine torque at each value of engine speed;

means for determining a third signal related to engine torque at each value of engine speed command;

means, responsive to said rack command value being at a predetermined value related to said maximum, for controlling said torque in response to sum of said third signal and said second signal to produce a first sum;

means for biasing said first sum to a low-speed side of an engine response; and means responsive to said rack command being less than said predetermined value for controlling said torque in response to a sum of said third signal and an engine torque produced with a rack displacement corresponding to said predetermined value.

2. Apparatus for controlling swash plates in at least one variable delivery pump, said variable delivery pump being of a type effective to absorb torque and power from an engine, comprising:

means for producing a torque signal indicative of a torque produced by said engine at all engine speeds;

means for injecting fuel into said engine;

said means for injecting fuel including a predetermined value;

means, responsive to said predetermined value, for controlling said torque in response to a difference between said torque signal and a controlled signal derived from a set engine speed and an actual engine speed; and means for biasing said difference to a low-speed side of a maximum speed, whereby said engine is controlled to operate in a fuel-efficient speed range.

3. Apparatus according to claim 2, further comprising: means responsive to a value of fuel injection less than said predetermined value for controlling said torque in response to a difference between said torque signal and a controlled signal equal to that which is produced during said predetermined value.

4. Apparatus according to claim 2, wherein:

said at least one variable delivery pump includes at least first and second variable delivery pumps;

means for controlling only said first variable delivery pump in response to a difference between said torque signal and a controlled signal equal to that which is produced during said predetermined value.

5. A method for controlling swash plates in at least one variable delivery pump, said variable delivery pump being of a type effective to absorb torque and power from an engine, comprising:

producing a torque signal indicative of a torque produced by said engine at all engine speeds;

injecting fuel into said engine;

the step of injecting fuel including a predetermined value;

during an existence of at least said predetermined value, controlling said torque in response to a difference between said torque signal and a controlled signal derived from a set engine speed and an actual engine speed; and biasing said difference to a low-speed side of a maximum speed, whereby said engine is controlled to operate in a fuel-efficient speed range.

6. A method according to claim 5, further comprising: in response to a value of fuel injection less than said predetermined value, controlling said wash plates in response to a difference between said torque signal and a controlled signal equal to that which is produced during said predetermined value.

7. A method according to claim 5, wherein:

said at least one variable delivery pump includes at least first and second variable delivery pumps;

controlling only said first variable delivery pump in response to a difference between said torque signal and a controlled signal equal to that which is produced during said predetermined value.

* * * * *